US005441201A

United States Patent [19]

Dombrowski

[11] Patent Number: 5,441,201

[45] Date of Patent: Aug. 15, 1995

[54] LIQUID SPRAY DEVICE

[75] Inventor: Norman Dombrowski, Salford, United Kingdom

[73] Assignee: The University of Leeds, West Yorkshire, England

[21] Appl. No.: 140,102

[22] PCT Filed: Apr. 24, 1992

[86] PCT No.: PCT/GB92/00757

§ 371 Date: Mar. 14, 1994

§ 102(e) Date: Mar. 14, 1994

[87] PCT Pub. No.: WO92/19385

PCT Pub. Date: Nov. 12, 1992

[30] Foreign Application Priority Data

Apr. 25, 1991 [GB] United Kingdom ..... 9108865

[51] Int. Cl.[6] ..... B05B 1/24; B05B 7/20

[52] U.S. Cl. ..... 239/75; 239/133; 239/135; 239/288

[58] Field of Search ..... 239/75, 129, 133, 135, 239/136, 137, 138, 139, 288

[56] References Cited

U.S. PATENT DOCUMENTS

| | | | |
|---|---|---|---|
| 2,068,892 | 1/1937 | Schweitzer et al. . | |
| 2,286,888 | 6/1942 | Arnold | 239/129 X |
| 2,644,717 | 7/1953 | Kopperschmidt . | |
| 2,737,415 | 3/1956 | Wheeler-Nicholson | 239/133 |
| 3,017,121 | 1/1962 | Carlson | 239/129 |
| 3,425,407 | 2/1969 | Furman et al. | 239/129 X |
| 4,132,357 | 1/1979 | Blackinton | 239/135 X |
| 4,179,068 | 12/1979 | Dombrowski | 239/129 X |
| 4,512,515 | 4/1985 | Tenney | 239/129 |
| 5,052,618 | 10/1991 | Carlon et al. | 239/129 X |

FOREIGN PATENT DOCUMENTS

| | | |
|---|---|---|
| 0043693A1 | 1/1982 | European Pat. Off. . |
| 0158097A1 | 10/1985 | European Pat. Off. . |
| 1014273 | 8/1952 | France . |
| 1561642 | 2/1980 | United Kingdom . |

*Primary Examiner*—William Grant
*Attorney, Agent, or Firm*—Sheridan Ross & McIntosh

[57] ABSTRACT

A liquid spray device particularly for agricultural and horticultural apparatuses is disclosed. A nozzle is provided through which liquid is emitted in a sheet, preferably a conical sheet. A source of heated air or gas, preferably a burner, is directed to interact with the liquid and is drawn through the liquid curtain to initiate the breakup into droplets of a liquid sheet, thus regulating the droplet size to minimize wastage of expensive agrochemicals or other materials. A shroud is provided to protect the gas in the vicinity of the nozzle from drafts. A thermal sensor is located in the shroud to interrupt the fuel supply to the flame or heated gas if the spray is interrupted.

10 Claims, 2 Drawing Sheets

LIQUID SPRAY DEVICE

The present application is a U.S. National Phase Application from International Application No. PCT/GB92/00757 with an International Filing Date of Apr. 24, 1992 and a priority date from Great Britain Application No. 9108865.8, filed Apr. 25, 1991.

FIELD OF THE INVENTION

The present invention relates to liquid spray devices, and more particularly to devices where liquid is discharged in the form of a thin sheet which subsequently breaks down to form droplets.

SUMMARY OF THE INVENTION

This invention relates to liquid spray devices, particularly but not exclusively to devices of the kind wherein liquid is discharged in the form of a thin sheet which subsequently breaks down to form droplets. The sheet can be flat or fan shaped or may have the shape of a hollow cone. The liquid spray devices of this invention find particular application in agricultural or horticultural spraying apparatus and in coating apparatus such as is used for paint application. Regulation of the droplet size is important, particularly to minimize wastage of expensive agrochemicals or other materials. Small drops which can be lost as mist or large drops which can fall to the ground are uneconomical and may create toxicity problems. Elimination of spray drive is especially important.

GB1561642 discloses a liquid spray device wherein hot gas from a methane burner is led to the vicinity of the orifice of a conical sprayer nozzle. The present invention relates to an improvement on the prior disclosure which enables the invention to be put into practice effectively. Several improvements are also realized.

According to the present invention, a liquid spray device includes a nozzle adapted to form a conical sheet of liquid which disintegrates downstream of the nozzle to form a spray, a source of heated gas and a shroud adapted to protect said gas in the vicinity of the nozzle from drafts the source being located so that the gas stream is directed onto the spray at a region wherein the sheet disintegrates to form droplets.

In preferred embodiments of the invention, the gas stream impinges directly on said region of the liquid so that heated gas is drawn through the conical liquid curtain so that the gas contacts the interior surface of it at the point of initiation of the break-up into droplets or immediately upstream of that point.

Transmission of heated gas to the interior of the cone through a tube is not practical due to the efficient cooling of the exterior of the tube by the constant flow of liquid over it. Application of the gas downstream of the break-up region is ineffective and application upstream, for example at the nozzle orifice is wasteful and can damage the nozzle.

Reduction in atmospheric pressure within the apex of the cone due to the Bernouilli effect is believed to draw combustion gas through the curtain without need for additional apparatus. Contact of warm ionized gas is believed to initiate rupture of the liquid sheet.

The heated gas stream is preferably provided by combustion of gaseous fuel, although liquid fuel burners may be employed. While electrically heated gas streams are not excluded, use of combustion gas is more efficient and practically convenient.

Use of the present invention affords many advantages. The droplet size distribution is enhanced by reduction in the number of undersized droplets. The apical angle of a conical spray is increased, enhancing the coverage achieved by the spray and allowing reduction in hydrostatic pressure.

A particular advantage arises because the heated gas stream is located at a precise position in spaced relation downstream of the nozzle. This reduces the heating of the nozzle in use allowing use of conventional plastic nozzles rather than expensive metal constructions.

In preferred embodiments of the invention, the shroud encloses the nozzle and has inlets through which air can be drawn by the spray, and an outlet for the spray and entrained air. The shroud is preferably arranged to enclose a toroidal body of gas to maintain the heated gas stream in contact with the break-up region of the sprayed liquid. The shroud also serves to protect the emergent spray from wind and other external influences.

In preferred embodiments of the invention, the shroud provides a jet pump to entrain ambient air and equalize pressure in the burner tube. This also serves to cool the burner tube. This may take the form of an open ended tube surrounding the burner jet at which fuel gas combustion occurs. The periphery of the shroud adjacent the outlet for the spray is preferably perpendicular to the latter. This serves to reduce turbulence within the shroud.

A thermal sensor may be located on the shroud on the opposite side to the inlet for heated gas. The sensor may be arranged to interrupt the fuel supply to the flame or other supply of heated gas if the spray is interrupted. This serves to prevent damage to the spray nozzle and shroud in the event that the cooling liquid spray is interrupted. In addition, pyrolysis or oxidation of agrochemicals, which can lead to toxic products, is avoided. This allows the nozzle and shroud to be fabricated from plastics or another heat sensitive material.

The burner unit is preferably arranged so that the inlet for heated gas is perpendicular to the axis of a conical spray, for example horizontal, radially to the axis of the conical spray in a downwardly directed agricultural sprayer.

A shroud may afford a secondary jet pump due to the passage of the body of liquid through it. This allows control of the mass density of the ionized species within the gas stream to optimize efficient droplet formation. This effect is enhanced by the perpendicular edge of the shroud and the proximity of the edge of the shroud to the conical body of liquid emergent from the apparatus.

BRIEF DESCRIPTION OF THE DRAWINGS

The invention is further described by means of example but not in any limitative sense with reference to the accompanying drawings of which.

DETAILED DESCRIPTION OF THE INVENTION

Figure 1:
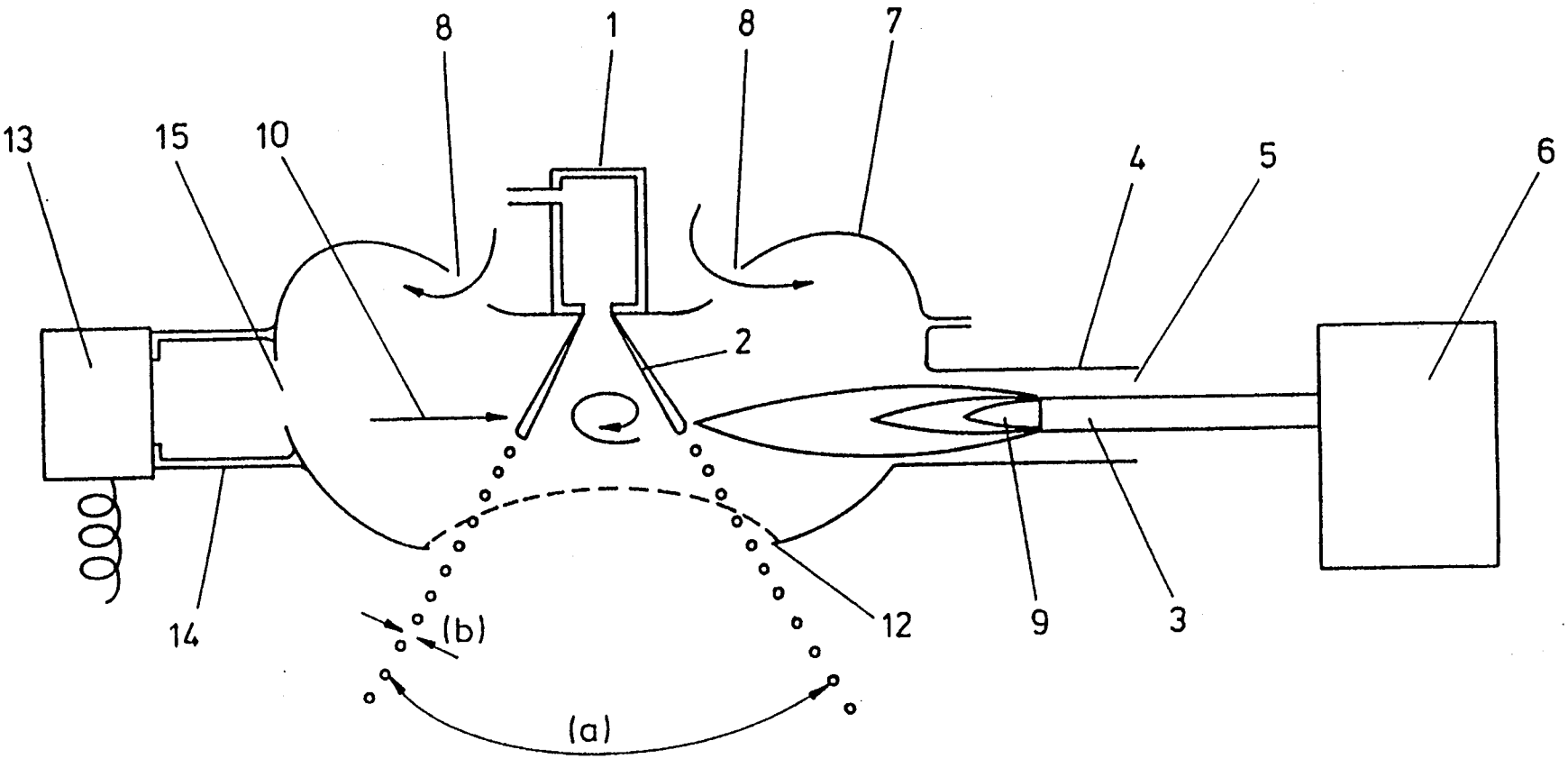
FIG. 1 is a cross-section through a sprayer in accordance with this invention.
Figure 2:
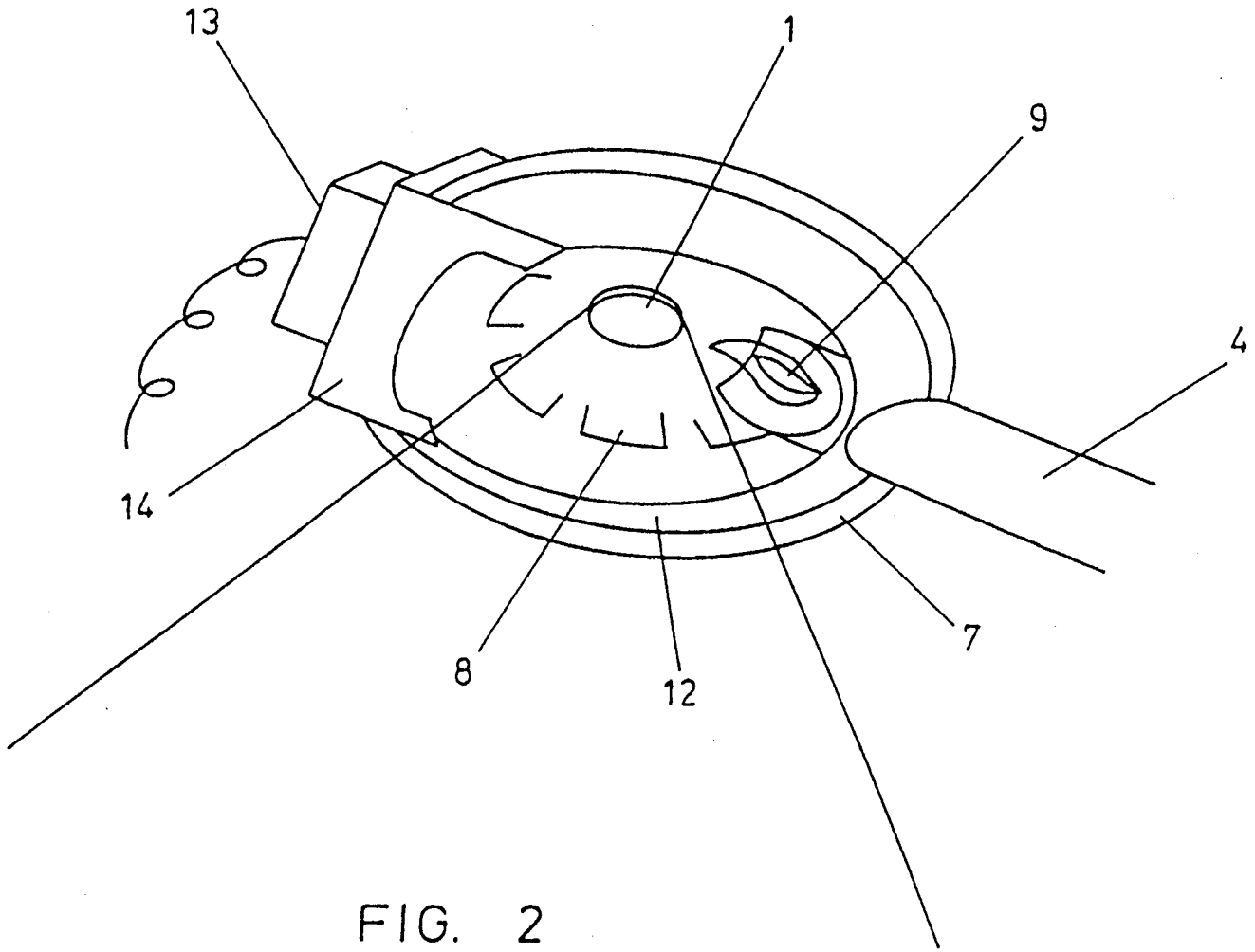
FIG. 2 is a view from beneath the sprayer shown in FIG. 1.

The sprayer shown in cross-section in FIG. 1 comprises a conventional plastic spray nozzle 1 having an inlet swirl chamber and outlet which generates a conical sheet of liquid 2. A burner 3 located within a tubular barrel 4 and controlled by a regulator 6, generates a flame 9 by combustion of hydrocarbon gas. Barrel 4 is open-ended at 5 to create a jet pump to accelerate heated gas from the flame 9 towards the sprayed liquid 2. The heated gas 9 impinges radially on the conical body of liquid 2 at the axial distance from the nozzle orifice shown by the arrow 10 where the sheet 2 breaks into droplets. Action of the heated gas 9 on the jet 2 causes the position of the break-up zone 10 to move upstream from the corresponding position where of the breakout zone when no heated gas is applied. The barrel 3 is located at a distance from the nozzle 1 at which a steady state is achieved in use of the apparatus. A toroidal shroud 7 having inlets 8 and an outlet 12 surrounds the spray to retain the heated gas in contact with the break-up zone 10. This may be conveniently achieved by arranging the inlet 8 so that air flows within the toroidal shroud to retain heated air adjacent the break-up zone 10. The Bernouilli effect causes a reduction of pressure within the cone 11 drawing heated gas through the liquid curtain 2. Promotion of the rupture of the liquid sheet 2 by ionized or other particles in the heated gas stream is enhanced by contact of the heated gas with the interior of the sheet as shown at 11. The apical angle of the emergent spray (a) is increased and the number of small droplets which form mist is reduced, reducing the losses from the spray. The thickness (b) of the annular ring of droplets in the spray curtain is reduced.

proximity of the periphery of the shroud 12 to the spray leaving the apparatus reduces the effect of drafts. Entrainment of air entering through the holes 8 in the body of sprayed liquid creates a jet pump effect drawing air into the interior of the shroud 7 to control the atmosphere within it. A heat sensor 13 located upon a support 14 is disposed behind an aperture 15 in the shroud opposite to the burner 3. Interruption of the liquid flow causes the flame 9 to contact the sensor 13 to actuate the regulator 6 and cut off the gas flow. Damage to the nozzle 1 and shroud by the presence of a flame is avoided.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

I claim:

1. A liquid spray device including, a nozzle adapted to form a conical sheet of liquid which disintegrates downstream of said nozzle to form a conical spray, said liquid sheet having an interior surface, a source of heated gas for forming a heated gas stream, and a shroud adapted to protect said gas stream in the vicinity of said nozzle from drafts, said shroud including an open-ended barrel extending therefrom, and said source being located within said open-ended barrel, so that said gas stream is directed onto said sheet at a region wherein said sheet disintegrates to form said spray.

2. A device as claimed in claim 1, wherein said heated gas stream is drawn, in use, through said liquid sheet and contacts said interior surface thereof.

3. A device as claimed in claim 1, wherein said source of heated gas is provided by combustion of gaseous or liquid fuel.

4. A device as claimed in claim 1, wherein said shroud encloses said nozzle and includes an inlet for air and an outlet for said spray.

5. A device as claimed in claim 4, wherein the periphery of said shroud adjacent said outlet is arranged to be perpendicular to said outlet.

6. A device as claimed in claim 1, further comprising an aperture in said shroud opposite said source of heated gas and a thermal sensor disposed on a support connected to said shroud behind said aperture.

7. A device as claimed in claim 1, wherein the longitudinal axis of said tubular barrel is perpendicular to the central axis of said conical spray.

8. A liquid spray device comprising:

a nozzle capable of forming a spray;

a burner capable of heating gas for impingement on said spray;

a shroud adapted to protect gas heated by said burner from drafts, said shroud enclosing said nozzle and having an open-ended tubular barrel extending therefrom;

said burner being located within said tubular barrel; and, said shroud having an outlet through which said spray impinged by said gas exits said shroud.

9. The device as set forth in claim 8, further comprising a thermal sensor located on said shroud.

10. The device as set forth in claim 8, wherein said nozzle is positioned opposite said outlet.

* * * * *